United States Patent [19]

Kroll et al.

[11] Patent Number: 4,719,325

[45] Date of Patent: Jan. 12, 1988

[54] CONTACT ARRANGEMENT WITH CONTACT LEVERS PIVOTED RELATIVE TO EACH OTHER IN A HOLDER

[75] Inventors: Joachim Kroll; Reinhard Kugler; Bernd Rambotzki, all of Berlin, Fed. Rep. of Germany

[73] Assignee: Siemens Aktiengesellschaft, Munich, Fed. Rep. of Germany

[21] Appl. No.: 924,681

[22] Filed: Oct. 28, 1986

[30] Foreign Application Priority Data

Nov. 7, 1985 [DE] Fed. Rep. of Germany ..... 3539786

[51] Int. Cl.[4] ..... H01H 33/12

[52] U.S. Cl. ..... 200/146 R; 200/144 R

[58] Field of Search ..... 200/146 R

[56] References Cited

U.S. PATENT DOCUMENTS 3,402,274 9/1968 Bould ..... 200/146

3,770,922 11/1973 Gryctko ..... 200/146

*Primary Examiner*—Robert S. Macon

*Attorney, Agent, or Firm*—Kenyon & Kenyon

[57] ABSTRACT

For receiving the contact levers of a contact arrangement, a holder is provided, in which the contact levers are supported so that they can be tilted relative to each other. The holder in turn can be moved in a stationary bearing strap for switching on and off. The bearing strap consists of two mirror-symmetrical angles which are assembled to each other by connecting straps at an unchangeable distance corresponding to the width of the holder. The connecting straps are preferably provided with openings into which material of the angles can be pushed by plastic deformation.

6 Claims, 7 Drawing Figures

CONTACT ARRANGEMENT WITH CONTACT LEVERS PIVOTED RELATIVE TO EACH OTHER IN A HOLDER

BACKGROUND OF THE INVENTION

The present invention relates to a contact arrangement having several contact levers which are pivoted relative to each other in a holder wherein the holder in turn can be moved about a stationary bearing for switching on and off.

A contact arrangement of this type has become known, for instance, from U.S. Pat. No. 3,402,274. For the behavior of such a contact arrangement when switching a large current such as can occur in the operation of low-voltage circuit breakers, not only the contact-making properties of the contacts touching each other, but also mechanical properties of the contact arrangement are of considerable importance. For instance, attraction forces act between adjacent contact levers through which the current therefore flows in the same direction, while the entire movable part of the contact arrangement can be subjected to lateral magnetic forces. In conjunction with unavoidable bearing play, these influences lead to a relative displacement of the contact overlays which not only causes wear due to friction of the contact surfaces relative to each other, but also to splattering and burn-off.

SUMMARY OF THE INVENTION

It is an object of the invention to increase the performance of multi-member contact arrangements by the provision that the bearing tolerance of the movable part of the contact arrangement is reduced as far as possible although such contact arrangements are mass-produced.

The above and other objects of the present invention are achieved by a contact arrangement having several contact levers which are pivoted relative to each other in a holder, where the holder in turn is movable about a stationary bearing for switching on and off, the bearing being designed as a bearing strap which surrounds the bearing as a bearing strap surrounding the holder and which is composed of parts which are matched to each other at a distance which is unchangeable and adapted to the holder.

Thus, the bearing is designed as a bearing strap extending around the holder which is assembled from a part which is matched to the holder and connected at an unchangeable distance. The bearing strap is given its final dimensions only when it is assembled to the holder of the contact levers. Independently of the width of the holder which can vary due to the tolerance of the semi-finished materials used as well as the tolerance of superficial layers as well as of shims and similar influences, the same bearing tolerance is thus always achieved within the strap.

Advantageously, such a bearing strap can comprise two angles designed with mirror symmetry, the one leg of which is arranged parallel to side walls of the holder and the further legs of which are arranged pointed toward each other, where the further legs are connected by connecting straps resting thereon at a dimensionally correct distance. This makes it possible to compose the bearing strap of different materials in order to achieve properties desirable in particular with respect to magnetic characteristics. If, for instance, connecting straps are chosen of nonmagnetic steel or another nonmagnetic material, the formation of a magnetic enclosure of the contact levers is avoided.

The connection of the parts of the bearing strap at an unchangeable distance can be brought about by the provision that the connecting straps, for use as a die, are provided with openings, into which material from the further legs of the angles can be pressed by plastic deformation. In this manner, a connection of the parts of the bearing strap is achieved which can take up considerable shear forces and which furthermore assures cohesion of the parts of the bearing strap with customary shop-like handling, until in addition to the die connection, other connecting means are applied, for instance, rivets, screws or a joining method such as spot welding.

It is advisable to design the openings for a material cross section sufficient for the complete transmission of stresses caused by current forces. The additional connecting means then need to transmit only normal forces.

Within the scope of the invention, a contact arrangement of the type described can be produced by a process with the following steps:

(a) the angles are positioned with the proper dimensions on both sides of the holder provided with contact levers;

(b) the connecting straps are placed on the further legs of the angles;

(c) by the application of pressure by means of a tool, the further legs are plastically deformed locally so far that material enters the openings of the connecting straps and thereby, the angles are connected to each other at a distance fitting the holder;

(d) the angles and the connecting straps are permanently connected by additional fastening elements.

The additional fastening means need to take up only forces which act in the direction of lifting the parts from each other, since the shear forces acting perpendicularly thereto are taken up by the die connection.

BRIEF DESCRIPTION OF THE DRAWINGS

The invention will be explained in greater detail in the following with the aid of the embodiment shown in the drawings, in which.

DETAILED DESCRIPTION

Figure 1:
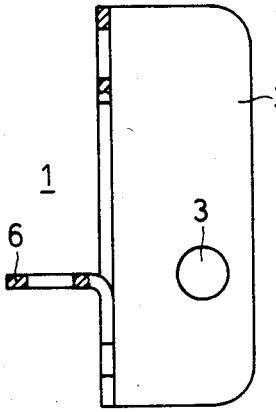
FIGS. 1, 2 and 3 show an angle as part of a bearing strap in three views which are perpendicular to each other, partly in cross section.
Figure 2:
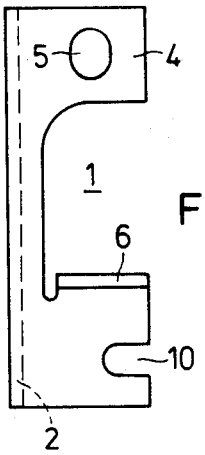
Figure 3:
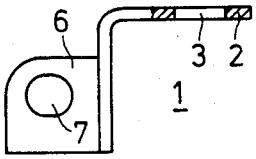
Figure 4:
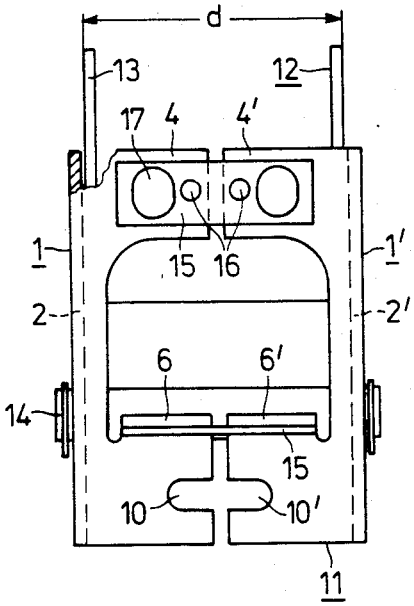
FIGS. 4 and 5 likewise show in two views perpendicular to each other and partly in cross section, a bearing strap composed of two mirror-symmetrical angles and connecting straps with parts of a holder for several contact levers.
Figure 5:
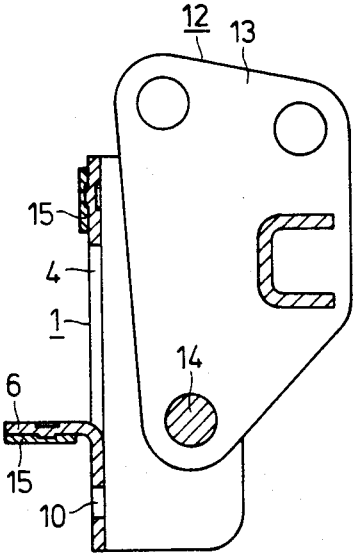

The angle 1 shown in FIGS. 1, 2 and 3 serves for fabricating a bearing strap such as is shown in FIGS. 4 and 5. The angle 1 has a leg 2 which is provided with an opening 3 for a bearing pin. A further leg 4 at right angles to the leg 2 likewise contains an opening 5 which is provided for receiving a screw to be inserted in the course of manufacturing the bearing strap. From the plane of the leg 4 is bent an extension 6 which likewise has a passage opening 7. The part of the leg 4 located below the extension 6 has a cutout 10 which is open laterally and serves for mounting the finished bearing strap into a switchgear during the installation.

A completed bearing strap 11 as shown in FIGS. 4 and 5 consists of an angle 1 according to FIGS. 1, 2 and 3 and a further angle 1' shaped as a perfect mirror image to that angle; further needed are connecting straps 15 in the form of rectangular pieces of sheet metal. These parts, i.e., the angles 1 and 1' as well as the connecting straps 15 are connected in such a manner that the distance of the legs 2 and 2' of the angles 1 and 1' corresponds with a tolerance as small as possible to the width d of a holder 12 serving for receiving contact levers. For positioning the parts, a bearing pin 14 engaging the side walls 13 of the holder 12 can be used which is provided in later operation for the tilting motion of the holder 12 for switching the contact arrangement on and off.

As shown particularly in FIG. 5, the legs 4 and 4' of the angles 1 and 1' are opposite each other with a spacing. The extensions 6 and 6' are logically in the same position. For bridging these parts connecting straps 15 are provided in the form of rectangular pieces of sheet metal of a nonmagnetic material which are each provided with two openings 16 as well as two further larger openings 17 on the outside. By plastic deformation of the material of the legs 4 and extension 6, material is now pressed into the openings 16 of the connecting straps 15 whereby a form-locking connection of the angles 2 and the connecting straps 15 is established. This process can be accomplished in different ways since hand tools as well as mechanical devices can be used. The result of the plastic deformation is a post of the extensions 6 and 6' which fix the angles 1 and 1' at a proper distance. It can be achieved by proper design of the openings 16 and the degrees of plastic deformation that the posts formed can completely take up shear forces occurring in the later operation of the contact arrangement.

The openings 17 of the connecting straps 15 are aligned with the respective openings 5 of the legs 4 and 4' respectively, and the openings 7 of the extensions 6 and 6', respectively. By inserting screws into these aligned openings, the parts of the bearing strap 11 are connected permanently, the screws merely ensuring the cohesion of the part while not taking over the shear forces that occur, or determining the dimensional accuracy of the bearing strap 11. Instead of the screws, other fastening means can also be employed, for instance, rivets, or spot welding or a similar process can be used. In the present case screws have the advantage that the bearing strap can be taken apart since also the die connection can be separated by suitable tools.

It is also possible to use, instead of the plastic deformation, other methods and fixtures in connection with the connecting straps 15 acting as a "lost die." For instance, connecting straps without die holes can be used and passage holes into which suitable connecting means, for instance, notched pins, can be inserted in the dimensionally correct position of the parts. In a similar manner, rivets can be used to establish the temporary connection transmitting the shear forces, as well as a permanent and undetachable connection. In this case as well as with local welding of the parts, there is no possibility, however, to take the bearing strap apart again if this is desired immediately following the first-time connection or later, for instance, if the circuit breaker is being repaired.

The application of the arrangement shown in FIGS. 4 and 5 will now be explained, referring to FIGS. 6 and 7. In these figures, a contact arrangement 20 for a low-voltage circuit breaker is shown which comprises a fixed part 21 and a movable part 22. The fixed part 21 comprises an insulating-material block 23 which supports an upper contact bar 24 and a lower forked contact bar 25. In conducting connection with the upper contact bar is a stationary contact 26 with a contact overlay 27 as well as a burn-off contact 31 with a further contact overlay 32 and an arcing horn 33. To the lower contact bar 25 are connected flexible current-carrying ribbons 34 which lead to two main contact levers 35 arranged on the outside and to a central burn-off contact. The two outer contact levers 35 have contact overlays 37, while the central contact lever 36 has a movable burn-off contact 40 with a contact overlay 41. In addition, an arcing horn 42 is in connection with the burnoff contact 40. The contact levers 35 and 36 are pivoted about a pivot 43 and are under the influence of compression springs which are arranged between the legs of the current-carrying ribbons 34 in a manner known per se.

The contact levers 35 and 36 are disposed in a holder 44, the design of which corresponds to the holder 12 in FIGS. 4 and 5, but the lateral parts 45 of which are shaped somewhat differently. The lateral parts 45 contain, besides the pivot pin 43, a bearing pin 46 as well as a coupling pin 47. The bearing pin 46 serves as the pivot of the movable parts 22 of the contact arrangement 20 about a bearing strap 50 which corresponds in principle to the bearing strap 11 in FIGS. 4 and 5 and is fastened to the insulating material block 23. The coupling pin 47 is engaged by insulating material block 23. The coupling pin 47 is engaged in insulating coupling members 51 which are connected to a suitable actuator of the circuit breaker. The side walls 45 of the holder 44 are held by two or more pins 53 at the distance determined by the contact levers 35 and 36 as well as by the interposed layers 52 located between them. On the basis of the known influence, the width of the holder may therefore be different. The bearing strap is matched to this width dimension in the manner described so that individual dimensional deviations are in principle taken into consideration also in quantity production of contact arrangements. All contact arrangements therefore have the smallest possible lateral guiding tolerance practically attainable.

Figure 6:
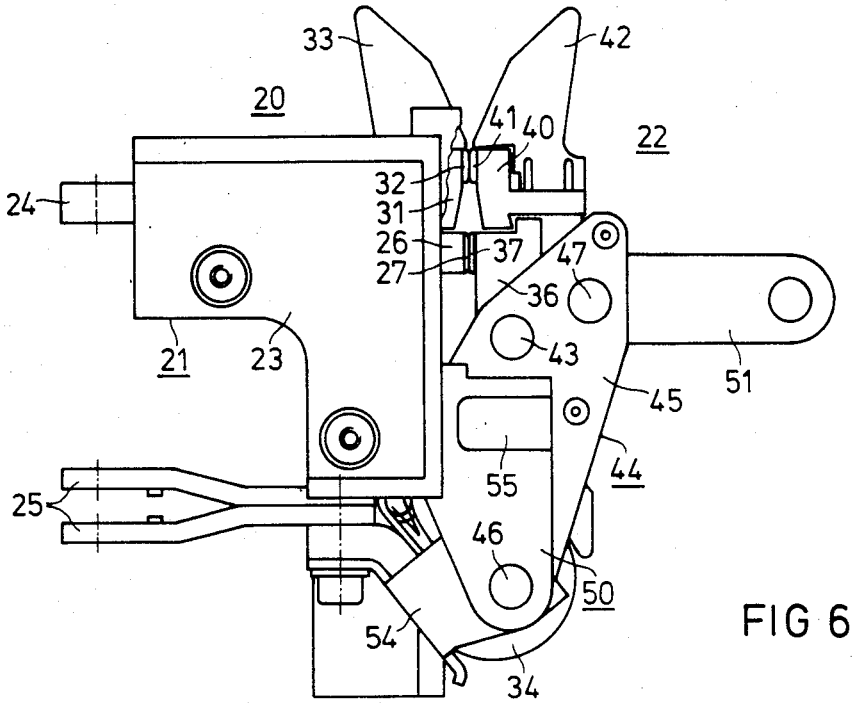
FIG. 6 shows a complete contact arrangement of a low-voltage circuit breaker in a side view.
Figure 7:
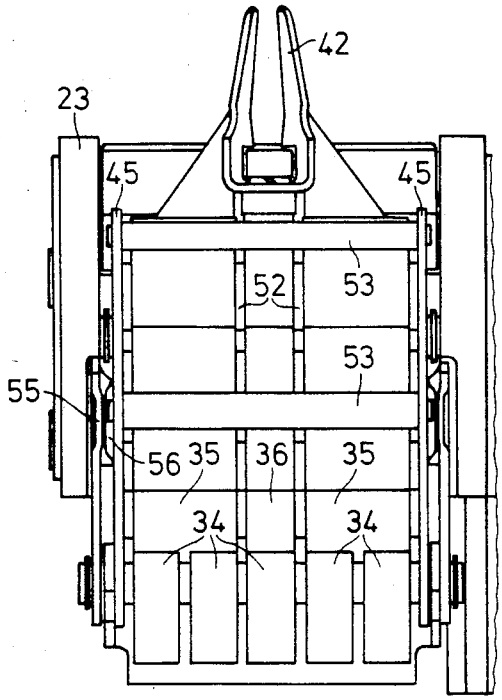
FIG. 7 shows the contact arrangement according to FIG. 6 in a front view.

In the example shown in FIGS. 6 and 7, support angles 54 for the current-carrying ribbons 34 engage between the side walls 45 of the holder 44 and the bearing strap. These angles, however, have no influence on the interaction of the bearing strap 50 with the holder 44 since these parts are provided with embossings 55 and 56 which face each other and serve as guiding surfaces. Due to the embossings 55 and 56, a spacing between the side walls 45 of the holder 44 and the bearing strap 50 is obtained which is in any case larger than the thickness of the support angles 54.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A contact arrangement having a plurality of contact levers which are pivoted relative to each other in a holder, the holder being movable about a stationary bearing for switching the contact arrangement on and off, the bearing comprising a bearing strap which surrounds the holder and which comprises at least two parts which are matched to each other and spaced at a fixed distance adapted to the holder.

2. The contact arrangement recited in claim 1, wherein the at least two parts of the bearing strap comprise two angles designed with mirror symmetry, one leg of each angle being arranged parallel to side walls of the holder and further legs of each angle being arranged facing each other, said further legs being connected at a dimensionally correct distance by at least one connecting strap disposed thereon.

3. The contact arrangement recited in claim 2, wherein the at least one connecting strap comprises a die having openings, material from the further legs of the angles being pressed into the openings by plastic deformation.

4. The contact arrangement recited in claim 3, wherein the openings of the connecting strap have a diameter such that they receive a cross section of the material sufficient for the complete transmissions of stresses caused by current forces.

5. The contact arrangement recited in claim 2, wherein the connecting strap comprises a nonmagnetic material.

6. A method for manufacturing a contact arrangement having a plurality of contact levers which are pivoted relative to each other in a holder, the holder being movable about a stationary bearing for switching the contact arrangement on and off, the bearing comprising a bearing strap which surrounds the holder and which comprises two angles designed with mirror symmetry, one leg of each angle being arranged parallel to side walls of the holder and further legs of each angle being arranged facing each other, said further legs being connected at a dimensionally correct distance by at least one connecting strap disposed thereon, the method comprising the steps of:

positioning the angles with correct dimensions on both sides of the holder;

placing the at least one connecting strap on the further legs of the angles;

plastically deforming the further legs locally by applying pressure by means of a tool so that material enters openings of the connecting strap and thereby the angles are connected to each other at a distance adapted to the holder; and connecting the angles and the at least one connecting strap to each other permanently by additional fastening elements.

* * * * *